US010714869B2

(12) United States Patent
Endo et al.

(10) Patent No.: US 10,714,869 B2
(45) Date of Patent: Jul. 14, 2020

(54) CONNECTOR

(71) Applicant: Yazaki Corporation, Tokyo (JP)

(72) Inventors: Tomomi Endo, Makinohara (JP); Yoshinori Ishikawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/561,251

(22) Filed: Sep. 5, 2019

(65) Prior Publication Data

US 2020/0106212 A1 Apr. 2, 2020

(30) Foreign Application Priority Data

Oct. 2, 2018 (JP) ..... 2018-187560

(51) Int. Cl.
*H01R 13/627* (2006.01)
*H01R 13/639* (2006.01)

(52) U.S. Cl.
CPC ..... *H01R 13/6273* (2013.01); *H01R 13/639* (2013.01)

(58) Field of Classification Search
CPC ..... H01R 13/6273; H01R 13/639; H01R 13/641; H01R 13/6274
See application file for complete search history.

(56) References Cited

U.S. PATENT DOCUMENTS 6,579,118 B2 * 6/2003 Endo ..... H01R 13/6272 439/352
6,918,783 B2 * 7/2005 Endo ..... H01R 13/6272 439/352
6,935,887 B2 * 8/2005 Endo ..... H01R 13/641 439/352
7,682,181 B1 * 3/2010 Jones, Jr. ..... H01R 13/6272 439/352
8,968,021 B1 * 3/2015 Kennedy ..... H01R 13/6273 439/352
9,048,576 B2 * 6/2015 McGivern ..... H01R 13/6273
9,142,919 B2 * 9/2015 Osada ..... H01R 13/6272
9,490,576 B2 * 11/2016 Plazio ..... H01R 13/639
9,742,115 B2 * 8/2017 Matsumoto ..... H01R 13/6272
10,305,221 B2 * 5/2019 Ohfuku ..... H01R 13/6273
2013/0210266 A1 8/2013 Osada et al.

FOREIGN PATENT DOCUMENTS

JP 2012-64461 A 3/2012

* cited by examiner

*Primary Examiner* — Briggitte R. Hammond
(74) *Attorney, Agent, or Firm* — Sughrue Mion, PLLC

(57) ABSTRACT

A connector includes a first housing, a second housing, and a fitting assurance member attached to the second housing and movable relative to the second housing in a state in which the first housing and the second housing are fitted to each other. The first housing includes a lock protrusion, and a first inclined surface and a second inclined surface. The first inclined surface and the second inclined surface are provided on opposite sides. The second housing includes a lock arm to lock the lock protrusion in the fitted state. The fitting assurance member includes a first repulsive arm to generate repulsive force when the first repulsive arm is elastically deformed by the first inclined surface during a fitting operation. The second housing includes a second repulsive arm to generate repulsive force when the second repulsive arm is elastically deformed by the second inclined surface during the fitting operation.

6 Claims, 11 Drawing Sheets

CONNECTOR

CROSS-REFERENCE TO RELAXED APPLICATION

The present application claims priority from Japanese Patent Application No. 2018-187560 filed on Oct. 2, 2018, the entire content of which is incorporated herein by reference.

BACKGROUND

The present invention relates to a connector.

A related art connector has a connector position assurance (CPA) function. More specifically, the related art connector has a male housing, a female housing, and a CPA member configured to keep the female housing fitted to the male housing. For example, the male housing has an inclined surface formed on an upper portion of the male housing, the female housing a lock arm, the CPA member has a repulsion arm provided on an upper portion of the CPA member, and the repulsion arm of the CPA member abuts, together with the lock arm of the female housing, against the inclined surface of the male housing such that repulsive force is generated between the male housing and the female housing (see, e.g., JP2012-064461A). With this connector, when the male housing and the female housing are not completely fitted to each other, the repulsive force moves the male housing and the female housing away from each other until the male housing and the female housing are not electrically connected to each other, so that fitting failures are prevented.

SUMMARY

To improve the recognition of the incomplete fitting, the repulsive force between the male housing and the female housing may be increased in a well-balanced manner. For example, the inclined surface may be provided also on the lower side of the connector, and the repulsion arm may be provided also a lower side of the CPA member, so that the repulsive force is generated at both the upper and lower sides of the connector.

However, providing the repulsion arms on both the upper and lower sides of the CPA member can increase an overall size of the connector. Further, the repulsive arms of the CPA member attached to cover an outer side of the female housing may be damaged due to, for example, being hit by a peripheral member or the like at a time of transportation of the connector, in which case the function of generating the repulsive force may be impaired.

Illustrative aspects of the present invention provide a connector which can improve the repulsive force to be generated between the housings during a process of fitting in a well-balanced manner, while keeping the connector compact and preventing the repulsion arms from being damaged.

According to an illustrative aspect of the invention, a connector includes a first housing, a second housing configured to be fitted to the first housing, and a fitting assurance member configured to be attached to the second housing and to be movable relative to the second housing in a fitted state in which the first housing and the second housing are fitted to each other. The first housing includes a lock protrusion, and a first inclined surface and a second inclined surface. The first inclined surface and the second inclined surface are provided on opposite sides of the first housing. The second housing includes a lock arm configured to lock the lock protrusion in the fitted state. The fitting assurance member includes a first repulsive arm configured to generate repulsive force when the first repulsive arm is elastically deformed by the first inclined surface during a process of fitting the second housing to the first housing. The second housing includes a second repulsive arm configured to generate repulsive force when the second repulsive arm is elastically deformed by the second inclined surface during the process of fitting the second housing to the first housing. The fitting assurance member includes a protective wall configured to protect the second repulsive arm of the second housing.

Other aspects and advantages of the invention will be apparent from the following description, the drawings and the claims.

DETAILED DESCRIPTION

Figure 1:
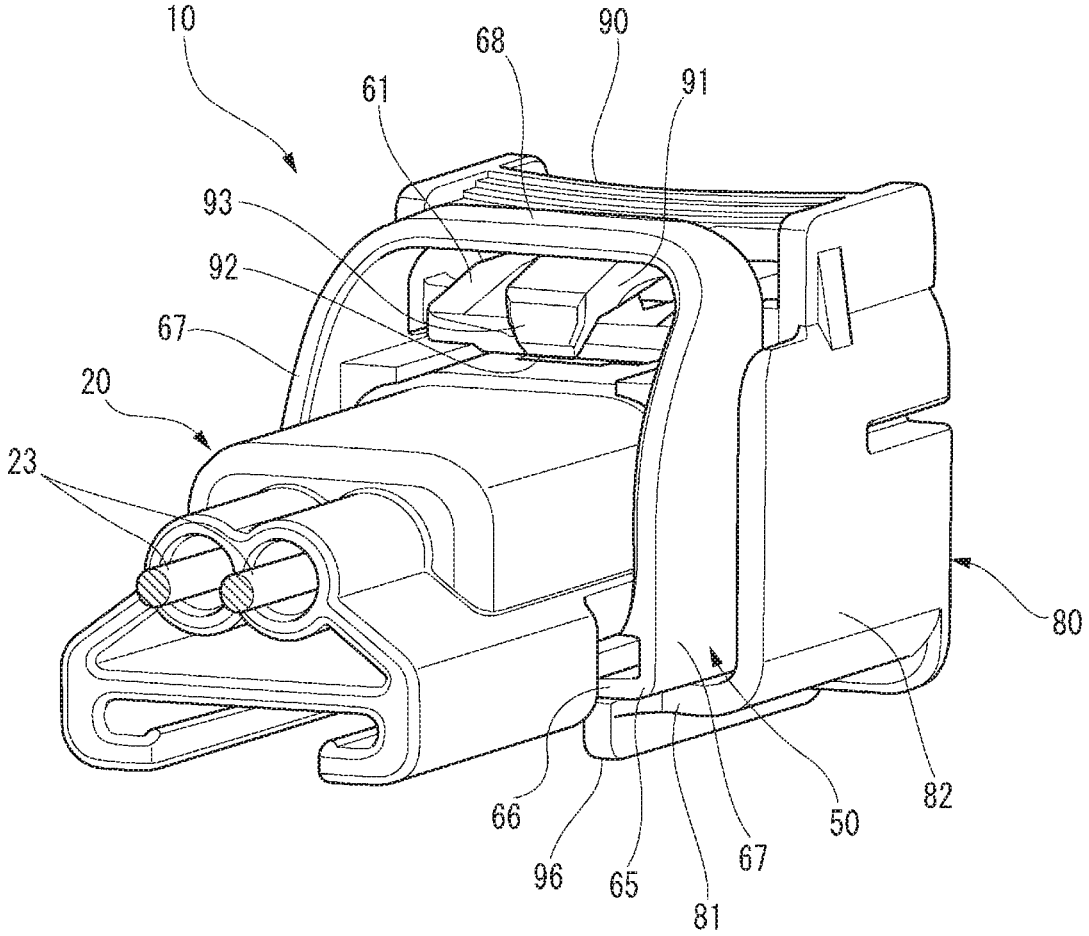
FIG. 1 is a perspective view of a connector according to an exemplary embodiment of the present invention.
Figure 2:
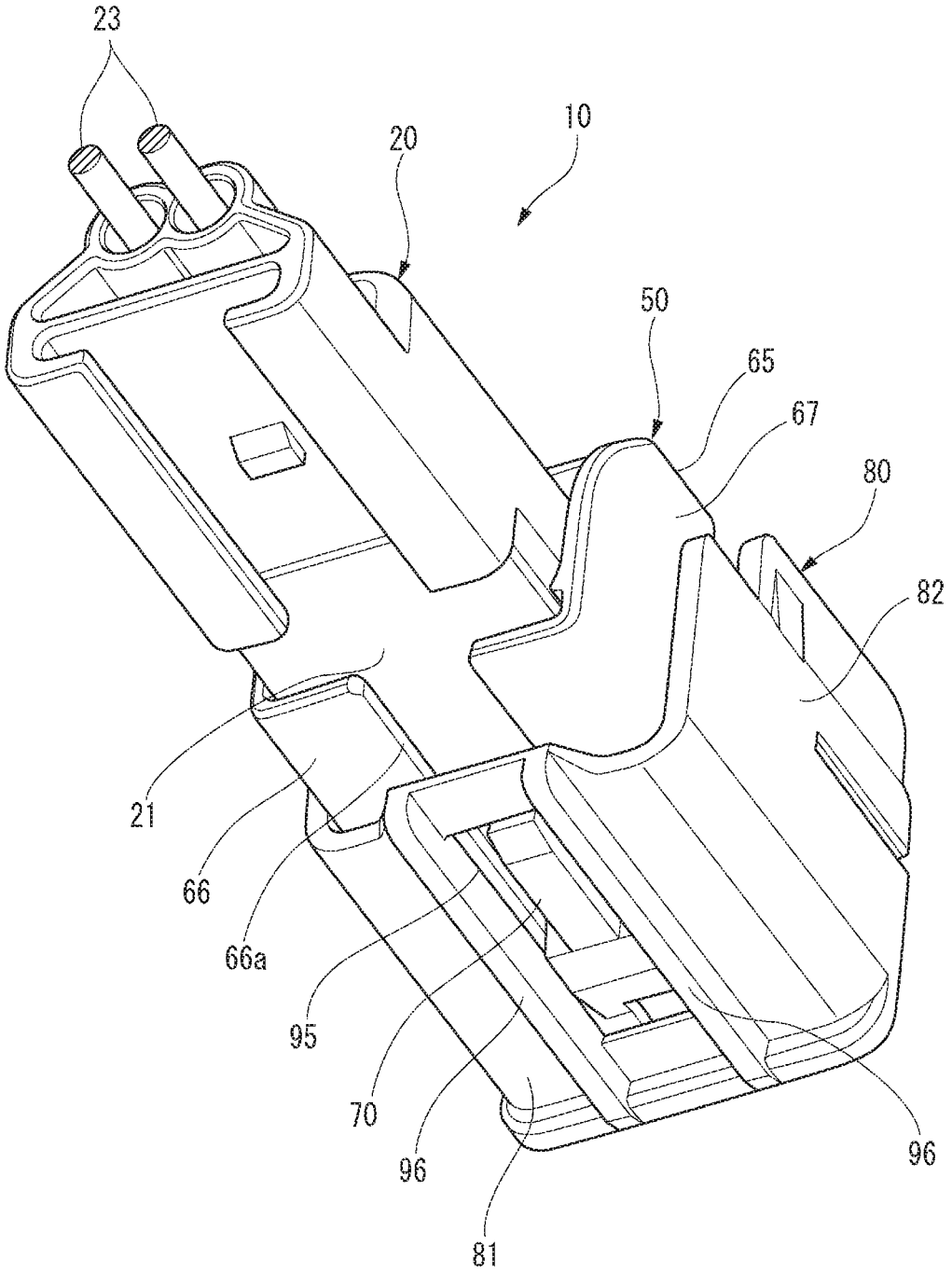
FIG. 2 is another perspective view of the connector as viewed from a bottom side of the connector.
Figure 3:
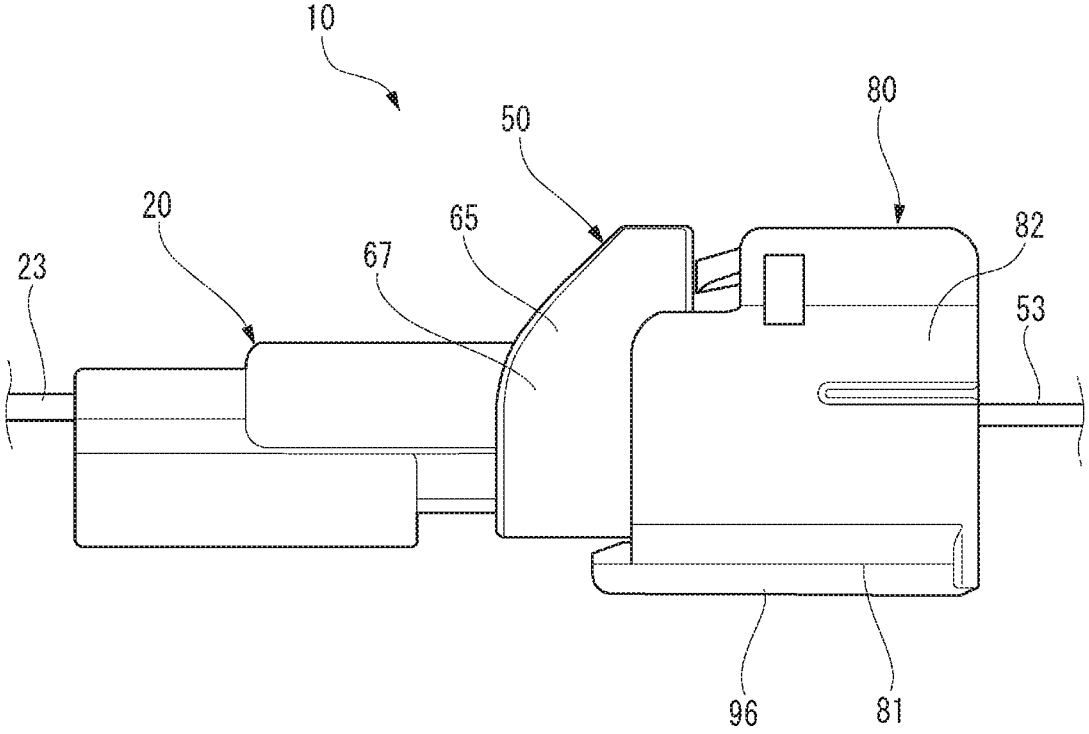
FIG. 3 is a side view of the connector.
Figure 4B:
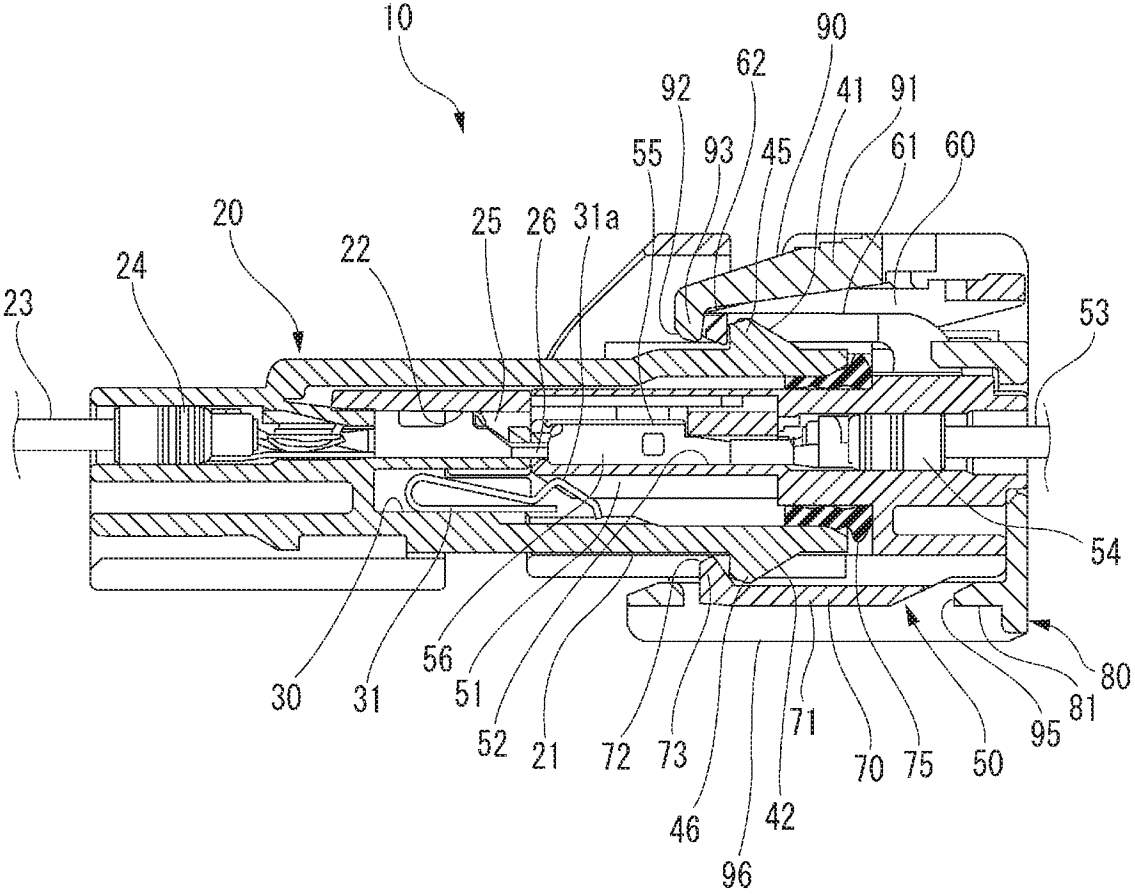
FIG. 4B is a cross-sectional view taken along the line A-A in FIG. 4A.
Figure 4A:
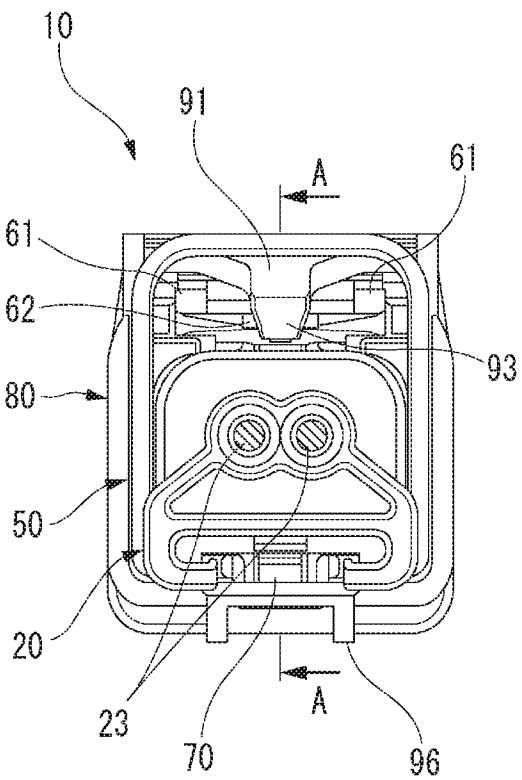
FIG. 4A is a front view of the connector as viewed from a side of a male housing side.
Figure 5:
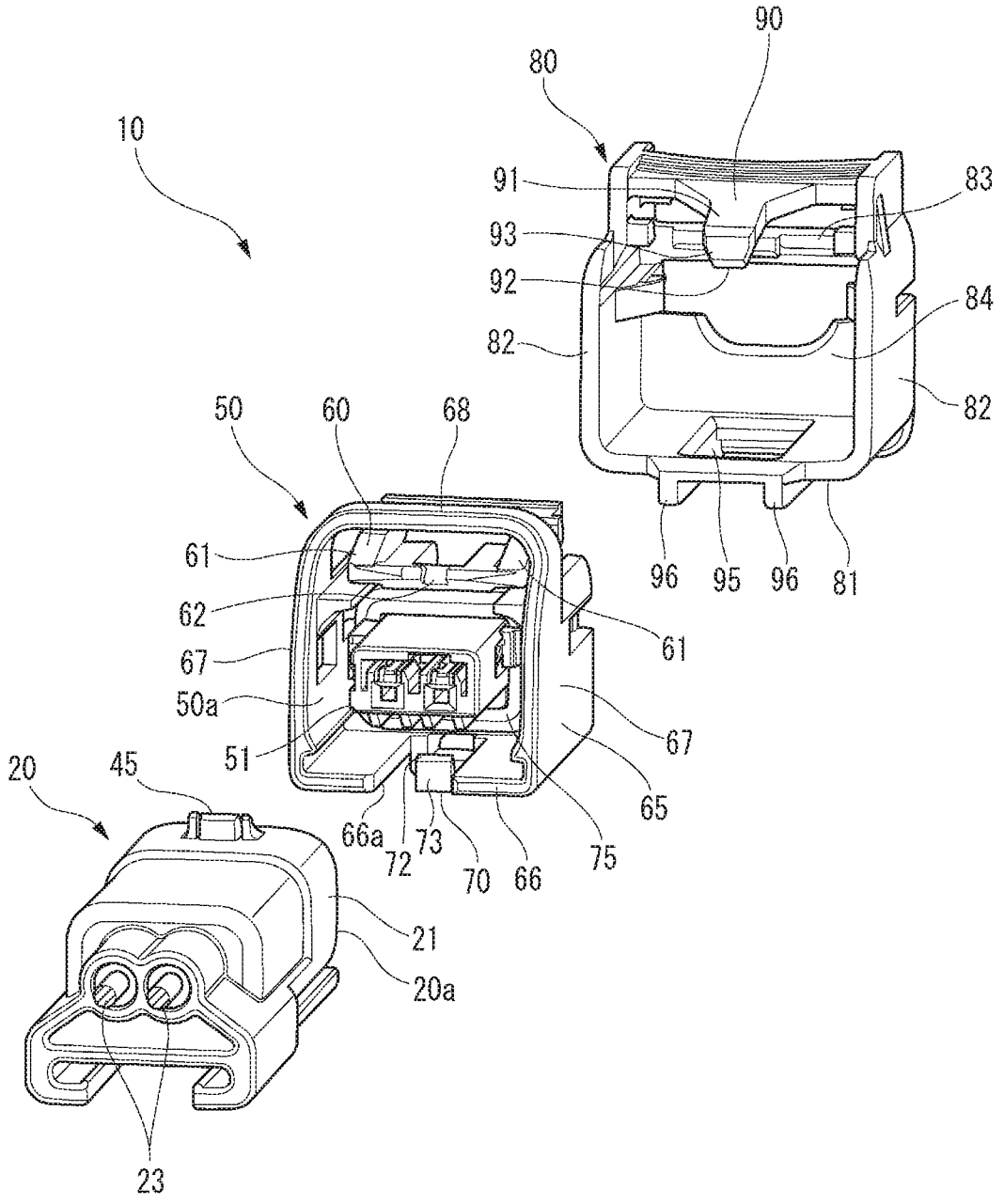
FIG. 5 is a perspective view of a male housing, a female housing, and a fitting assurance member of the connector.

Hereinafter, exemplary embodiments of the present invention will be described with reference to the drawings.

As illustrated in FIGS. 1 to 5, a connector 10 according to an exemplary embodiment of the present invention includes a male housing 20 (an example of a first housing), a female housing 50 (an example of a second housing) fitted to the male housing 20, and a fitting assurance member 80 to be attached to the female housing 50. The male housing 20 includes a fitting portion 20*a*, and the female housing 50 includes a connection portion 50*a*. The male housing 20 and the female housing 50 are joined to each other by fitting the connection portion 50*a* of the female housing 50 into the fitting portion 20*a* of the male housing 20. The connector 10 is, for example, an electrical connector of an in-vehicle airbag system provided in an automobile or the like. The connector 10 has a connector position assurance (CPA) function. More specifically, the fitting assurance member 80 is configured to keep the female housing 50 fitted to the male housing 20. The fitting assurance member 80 attached to the female housing 50 that has already been fitted to the male housing 20 is pushed so as to be fully locked, so that the male housing 20 and the female housing 50 are locked in a completely fitted manner, and this completely fitted state is kept by the fitting assurance member 80. When the male housing 20 and the female housing 50 are not sufficiently fitted to each other, the fitting securing member 80 is movable relative to the female housing 50. Therefore, e when the fitting assurance member 80 is movable relative to the female housing 50, a worker can recognize that the male housing 20 and the female housing 50 are not completely fitted to each other.

The male housing 20 is molded from a synthetic resin and includes a cylindrical hood portion 21 on a fitting portion 20*a* side. Two terminal housing chambers 22 are formed in the male housing 20. Male terminals 25 connected to end portions of electric wires 23 are housed in the terminal housing chambers 22, and the electric wires 23 are drawn out from a rear end of the male housing 20. A seal member 24 attached to the electric wire 23 is fitted into the terminal housing chamber 22 from a rear end side of the male housing 20. Accordingly, the terminal housing chamber 22 of the male housing 20 housing the male terminal 25 is water-stopped.

The male terminal 25 is formed of, for example, a conductive metal material which is copper, a copper alloy, or the like, and is crimped to and connected to the electric wire 23. The male terminal 25 includes a tab 26 formed in a pin shape, and the tab 26 is disposed in the hood portion 21.

The male housing 20 includes a housing recessed portion 30 at a position adjacent to the terminal housing chamber 22, and a short terminal 31 is housed in the housing recessed portion 30. The short terminal 31 is formed of, for example, a conductive metal material which is copper, a copper alloy, or the like, and is formed in a substantially U shape in a side view including a contact point 31*a*. In the short terminal 31, the contact point 31*a* is in contact with the tab 26 of the male terminal 25 in a non-fitted state where the female housing 50 is not fitted to the male housing 20. Accordingly, the male terminals 25 are electrically connected to each other at the short terminal 31, and, for example, the circuit on an inflator side of an airbag system is short-circuited. Accordingly, for example, in a circuit on the inflator side, when the warning light is turned on, it is warned that the female housing 50 is not properly fitted to the male housing 20.

The male housing 20 includes a first inclined surface 41 and a second inclined surface 42 in the hood portion 21. The first inclined surface 41 and the second inclined surface 42 are respectively formed on an upper surface and a lower surface which are opposite side surfaces of the male housing 20. The first inclined surface 41 and the second inclined surface 42 are gradually inclined outward in a fitting direction of the female housing 50. The male housing 20 also includes lock protrusions 45, 46. The first inclined surface 41 is formed on the lock protrusion 45, and the second inclined surface 42 is formed on the lock protrusion 46.

The female housing 50 is molded from a synthetic resin, and a fitting protrusion 51 to be fitted to the hood portion 21 of the male housing 20 is provided in a protruding manner on a fitting portion 20*a* side. Two terminal housing chambers 52 are formed in the female housing 50. Female terminals 55 connected to end portions of electric wires 53 are housed in the terminal housing chambers 52, and the electric wires 53 are drawn out from a rear end of the female housing 50. A seal member 54 attached to the electric wire 53 is fitted into the terminal housing chamber 52 from a rear end side of the female housing 50. Accordingly, the terminal housing chamber 52 of the female housing 50 housing the female terminal 55 is water-stopped.

The female terminal 55 is formed of, for example, a conductive metal material which is copper, a copper alloy, or the like, and is crimped to and connected to the electric wire 53. The female terminal 55 includes an electrical connection portion 56 formed in a cylindrical shape. The tab 26 of the male terminal 25 is inserted into the electrical connection portion 56 by fitting the fitting protrusion 51 of the female housing 50 to the hood portion 21 of the male housing 20. Accordingly, the male terminal 25 of the male housing 20 and the female terminal 55 of the female housing 50 are electrically connected.

The female housing 50 includes a lock arm 60 at an upper portion of the female housing 50. The lock arm 60 includes a pair of elastically deformable arm portions 61 extending forward from a rear end of the lock arm 60, and a locking portion 62 connected to a distal end portion of each of the arm portions 61. In the lock arm 60, the locking portion 62 locks the lock protrusion 45 of the male housing 20 in a fitted state where the female housing 50 is fitted to the male housing 20.

The female housing 50 includes a peripheral wall portion 65. The peripheral wall portion 65 is integrally connected on a rear end side of the fitting protrusion 51, and a periphery of the fitting protrusion 51 is surrounded by the peripheral wall portion 65. The peripheral wall portion 65 includes a bottom wall 66, side walls 67 erected from both side edges of the bottom wall 66, and a bridge 68 connecting upper ends of the side walls 67. A cutout portion 66*a* is formed in the bottom wall 66 of the peripheral wall portion 65.

The female housing 50 includes a second repulsive arm 70 at a lower portion of the female housing 50. The second repulsion arm 70 is disposed in the cutout portion 66*a* formed in the bottom wall 66 of the peripheral wall portion 65. The second repulsion arm 70 includes an elastically deformable arm portion 71 extending forward of the female housing 50. A claw portion 73 including a sliding surface 72 is formed at a distal end of the elastically deformable arm portion 71. The sliding surface 72 is formed at the same inclination angle as the second inclined surface 42 of the male housing 20. When the female housing 50 is fitted to the male housing 20, the second repulsion arm 70 slides with the sliding surface 72 abutting against the second inclined surface 42 of the male housing 20.

An annular seal member 75 is mounted to the fitting protrusion 51 of the female housing 50 on a rear end side of the fitting protrusion 51. When the female housing 50 is fitted to the male housing 20, the hood portion 21 of the male housing 20 is in close contact with the seal member 75. Accordingly, a space between the hood portion 21 of the male housing 20 and the fitting protrusion 51 of the female housing 50 is water-stopped by the seal member 75.

The fitting assurance member 80 is formed of a synthetic resin and is formed into a box shape with an open front side. The fitting assurance member 80 is attached to the female housing 50 from a rear end side of the female housing 50, whereby the female housing 50 is fitted into the fitting assurance member 80. The fitting assurance member 80 includes a protective wall 81 which is a bottom portion, side walls 82 erected from both side edges of the protective wall 81, a bridge portion 83 connecting upper ends of the side walls 82, and a rear wall 84 erected from a rear edge of the protective wall 81.

The fitting assurance member 80 includes a first repulsive arm 90 at an upper portion of the fitting assurance member 80. The first repulsive arm 90 is formed at the upper ends of the side walls 82. The first repulsion arm 90 includes an elastically deformable aria portion 91 extending forward of the fitting assurance member 80. A claw portion 93 including a sliding surface 92 is formed at a distal end of the elastically deformable arm portion 91. The sliding surface 92 is formed at the same inclination angle as the first inclined surface 41 of the male housing 20. When the female housing 50 with the fitting assurance member 80 is fitted to the male housing 20, the first repulsion arm 90 slides with the sliding surface 92 abutting against the first inclined surface 41 of the male housing 20.

The fitting assurance member 80 includes an opening portion 95 in the protective wall 81 which is the bottom portion of the fitting assurance member 80. The second repulsive arm 70 of the female housing 50 is housed in the opening portion 95 when the fitting assurance member 80 is attached to the female housing 50. When the second repulsive arm 70 is not in contact with the second inclined surface 42 so that the second repulsive arm 70 is not elastically deformed, the second repulsive arm 70 is disposed on an inner side from an outer surface of the protective wall 81. On the protective wall 81, ribs 96 protruding outward are formed at both edge portions of the opening portion 95 in a width direction.

Figure 6A:
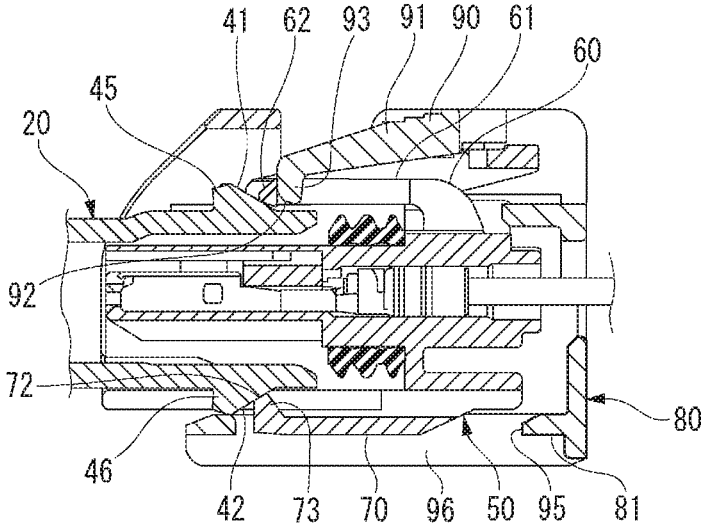
FIGS. 6A to 6C are side cross-sectional views of a part of the connector, sequentially illustrating a process of fitting the female housing to the male housing.
Figure 6B:
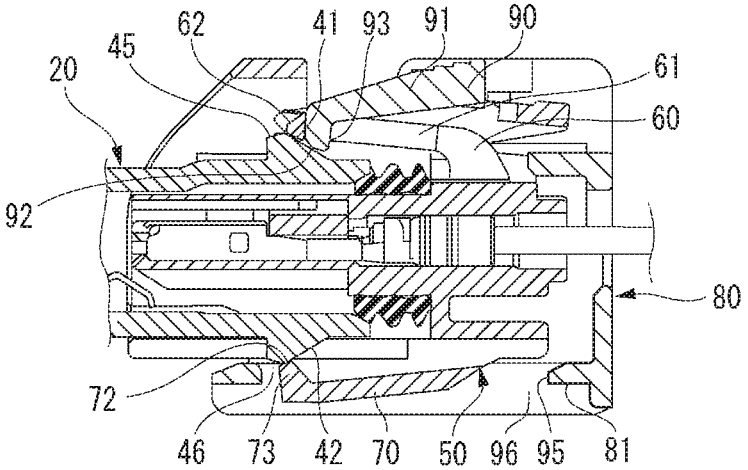
Figure 6C:
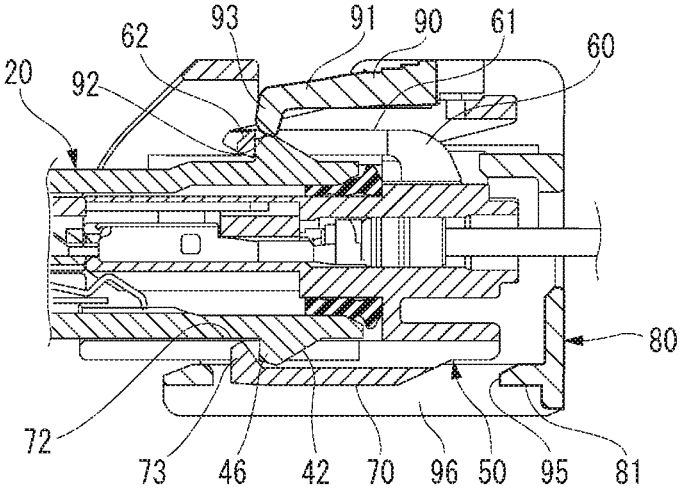

Next, the fitting of the male housing 20 and the female housing 50 of the connector 10 will be described with reference to FIGS. 6A to 6C.

First, the fitting assurance member 80 is attached to the female housing 50. Specifically, the fitting assurance member 80 is attached to the female housing 50 from the rear side of the female housing 50 such that the female housing 50 is fitted in the fitting assurance member 80. In this state, the second repulsive arm 70 of the female housing 50 is disposed in the opening portion 95 of the protective wall 81 of the fitting assurance member 80 without protruding outward from the outer surface of the protective wall 81. The claw portion 93 of the first repulsive arm 90 of the fitting assurance member 80 is disposed at a rear portion of the locking portion 62 of the lock arm 60 of the female housing 50.

With the fitting assurance member 80 being attached to the female housing 50, the connection portion 50*a* of the female housing 50 is brought closer toward the fitting portion 20*a* of the male housing 20. Then, as illustrated in FIG. 6A, the fitting protrusion 51 of the female housing 50 is fitted to the hood portion 21 of the male housing 20. Then, the locking portion 62 of the lock arm 60 of the female housing 50 and the sliding surface 92 of the claw portion 93 of the first repulsive arm 90 of the fitting assurance member 80 abut against the first inclined surface 41 of the male housing 20. The sliding surface 72 of the claw portion 73 of the second repulsive arm 70 of the female housing 50 abuts against the second inclined surface 42 of the male housing 20.

The fitting protrusion 51 of the female housing 50 is fitted into the hood portion 21 of the male housing 20. Then, as illustrated in FIG. 6B, the locking portion 62 of the lock arm 60 and the sliding surface 92 of the first repulsive arm 90 abutting against the first inclined surface 41 of the male housing 20 slide on the first inclined surface 41, and the sliding surface 72 of the second repulsive arm 70 abutting against the second inclined surface 42 of the male housing 20 slides on the second inclined surface 42. Accordingly, the lock arm 60, the first repulsive arm 90, and the second repulsive arm 70 are elastically deformed outward. In a state where the female housing 50 is in a process of fitting to the male housing 20, a component force of a restoring force of the lock arm 60, the first repulsive arm 90, and the second repulsive arm 70 elastically deformed acts as a repulsive force in a direction away from the male housing 20 in the female housing 50 and the fitting assurance member 80.

The fitting protrusion 51 of the female housing 50 is fitted into the hood portion 21 of the male housing 20 against the repulsive force. Then, as illustrated in FIG. 6C, the male housing 20 and the female housing 50 are fitted, the tab 26 of the male terminal 25 is inserted into the electrical connection portion 56 of the female terminal 55, and the male terminal 25 and the female terminal 55 are electrically connected. In the fitted state, the locking portion 62 of the lock arm 60 rides over the lock protrusion 45, so that the lock arm 60 is restored and the locking portion 62 locks the lock protrusion 45. The claw portion 73 of the second repulsion arm 70 rides over the lock protrusion 46 so that the second repulsive arm 70 is restored. Accordingly, the claw portion 73 of the second repulsive arm 70 locks the lock protrusion 46. Thus, the female housing 50 is locked so as to be fitted to the male housing 20.

When the fitting assurance member 80 is pushed toward the male housing 20 from the fitted state and slid relative to the female housing 50, the claw portion 93 of the first repulsive arm 90 rides over the locking portion 62 of the lock arm 60 locking the lock protrusion 45, so that the first repulsive arm 90 is restored. Accordingly, the claw portion 93 of the first repulsive arm 90 locks the locking portion 62 of the lock arm 60 locking the lock protrusion 45 (see FIG. 4B). That is, the fitting assurance member 80 attached to the female housing 50 is fully locked, whereby the fitted state of the female housing 50 to the male housing 20 is maintained.

As described above, in the connector 10, the first repulsive arm 90 locks the lock arm 60 locking the lock protrusion 45. Therefore, the fitted state of the female housing 50 to the male housing 20 can be reliably maintained and high connection reliability can be obtained.

With the connector 10 described above, the first repulsive arm 90 of the fitting assurance member 80 and the second repulsive arm 70 of the female housing 50 are elastically-deformed to generate a repulsive force by the first inclined surface 41 and the second inclined surface 42 formed on the upper surface and the lower surface which are opposite side surfaces of the male housing 20. Accordingly, the repulsive force in the process of fitting can be maintained in a well-balanced manner, and the female housing 50 can be pushed back to the male housing 20 until the male terminal 25 and the female terminal 55 are not electrically connected in the process of fitting. Moreover, the first repulsive arm 90 is provided in the fitting assurance member 80 and the second repulsive arm 70 is provided in the female housing 50. Therefore, an overall size of the connector 10 can be made smaller as compared with a case where two repulsive arms are provided on the fitting assurance member 80.

The protective wall 81 configured to protect the second repulsive arm 70 of the female housing 50 is provided in the fitting assurance member 80. Therefore, it is possible to prevent a decrease in the repulsive force due to damage of the second repulsive arm 70. When the second repulsive arm 70 is not elastically deformed, the second repulsive arm 70 in the opening portion 95 of the protective wall 81 is disposed on an inner side from the outer surface of the protective wall 81. Therefore, the second repulsive arm 70 can be protected while keeping the connector 10 compact.

Moreover, the second repulsive arm 70 can be protected by the rib 96 formed at an edge portion of the opening portion 95 of the protective wall 81 even when the second repulsive arm 70 is elastically deformed outward. Accordingly, the second repulsive arm 70 can be protected not only during transportation and in the fitted state but also in the process of fitting to the male housing 20.

Next, a connector 10A according to according to another exemplary embodiment of the present invention will be described with reference to FIGS. 7 and 8.

Figure 7:
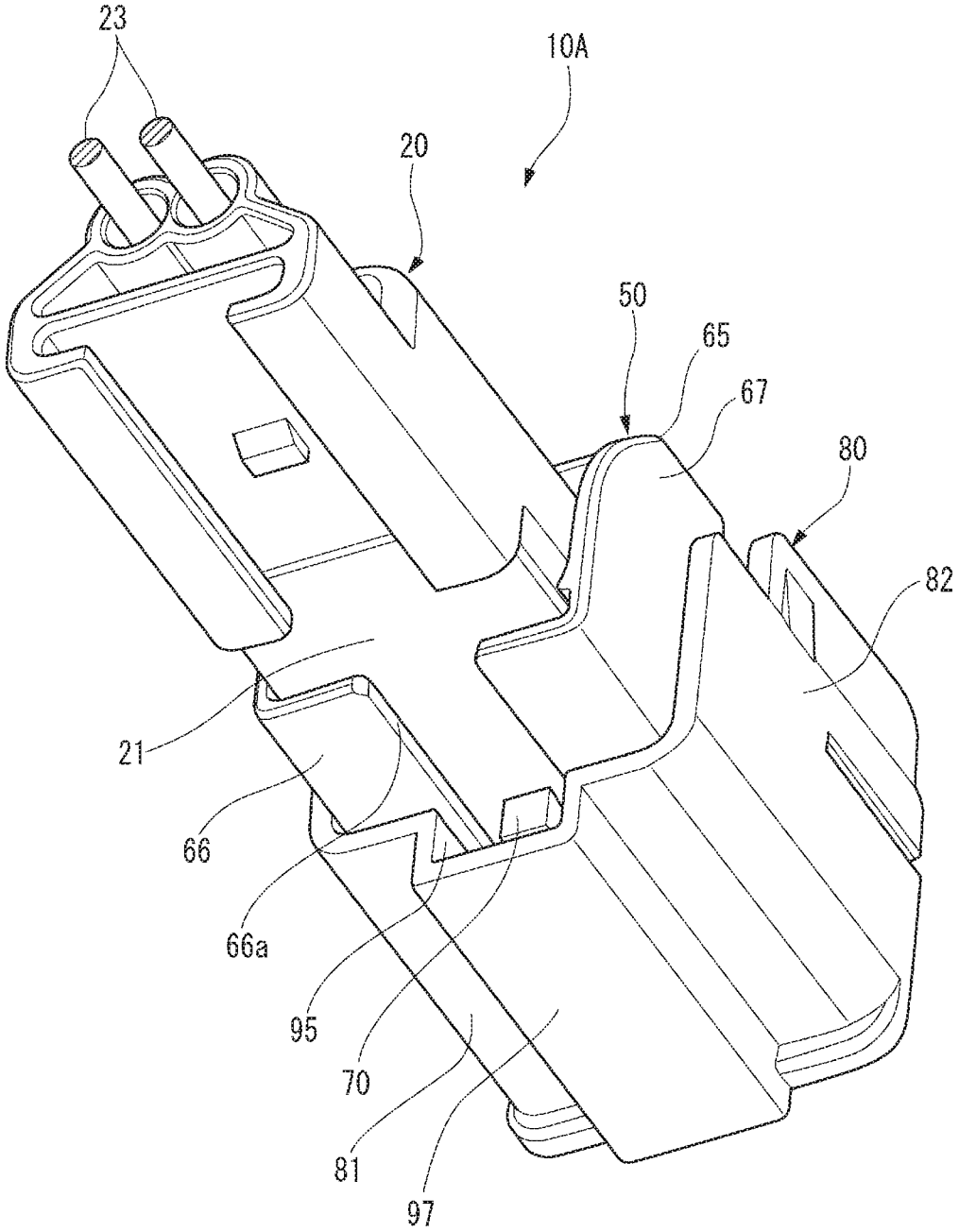
FIG. 7 is a perspective view of a connector according to another exemplary embodiment of the present invention as viewed from a bottom side of the connector.
Figure 8:
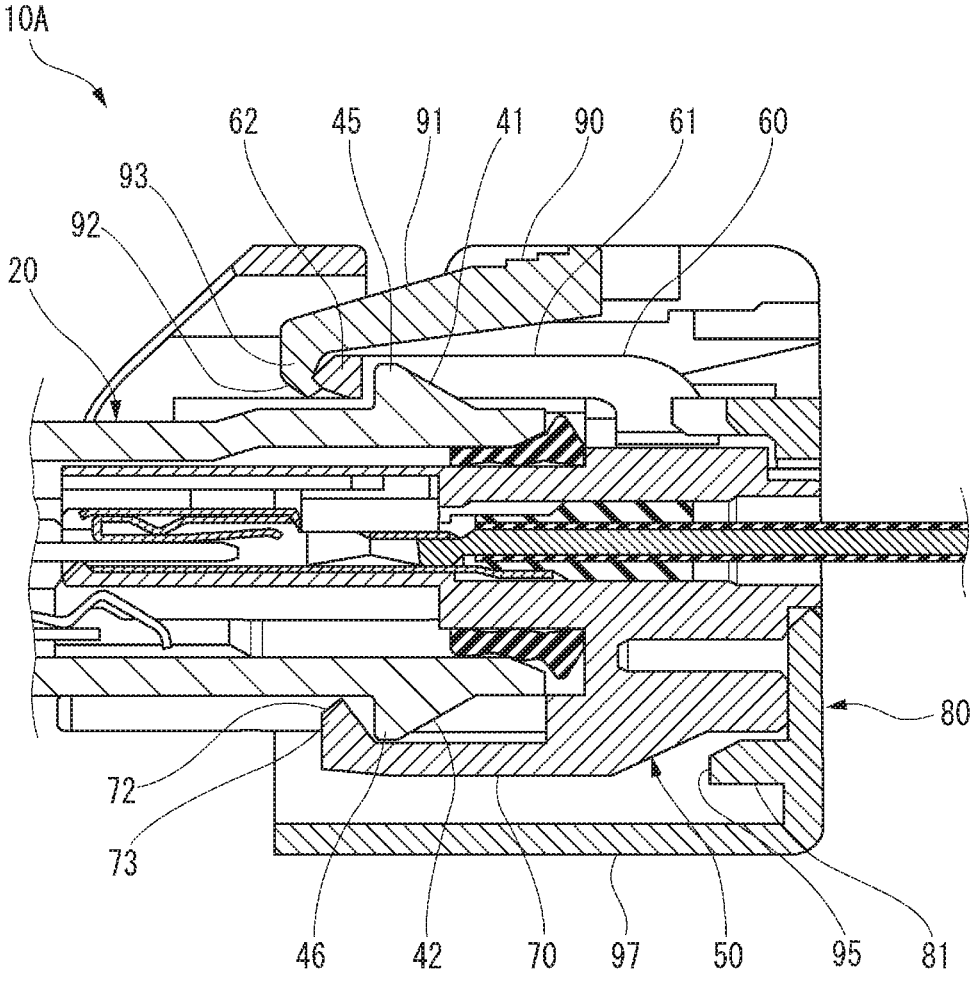
FIG. 8 is a side cross-sectional view of a part of the connector of FIG. 7.

As illustrated in FIGS. 7 and 8, the connector 10A has a cover 97 is integrally formed on the protective wall 81 of the fitting assurance member 80. An outer side of the opening portion 95 formed in the protective wall 81 is covered with the cover 97.

With this connector 10A, even when the second repulsive arm 70 of the female housing 50 is elastically deformed outward such that the fitting assurance member 80 is attached to the female housing 50, the second repulsive arm 70 is covered with the cover 97. Accordingly, during the fitting operation of the female housing 50 to the male housing 20, it is possible to more reliably prevent the second repulsive arm 70 from being damaged by touching the second repulsive arm 70 elastically deformed outward.

Figure 9:
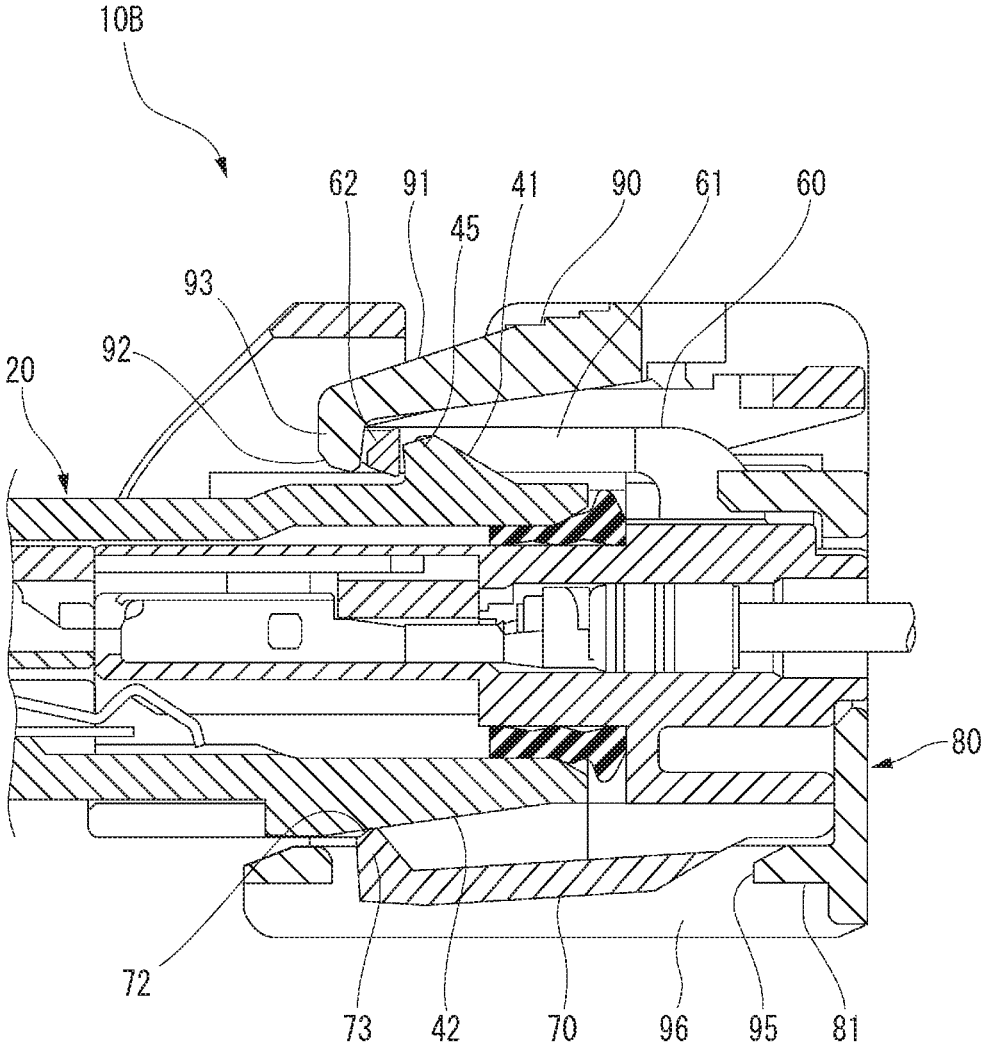
FIG. 9 is a side cross-sectional view of a part of a connector according to another exemplary embodiment of the present invention.

FIG. 9 is a side cross-sectional view of a part of a connector 10B according to another exemplary embodiment of the present invention. As illustrated in FIG. 9, the second inclined surface 42 on a lower side of the male housing 20 is different from the first inclined surface 41 on an upper side in inclination angle. Specifically, an inclination angle of the second inclined surface 42 on the lower side is gentler with respect to the first inclined surface 41 on the upper side. The male housing 20 is formed with the lock protrusion 45 only on the upper side.

In the connector 103, repulsive forces generated by the first inclined surface 41 and the second inclined surface 42 in the process of fitting of the female housing 50 to the male housing 20 are different. Specifically, the repulsive force generated by the second inclined surface 42 on the lower side is gently increased with respect to the repulsive force generated by the first inclined surface 41 on the upper side. In the connector 10B, the second repulsive arm 70 abuts against the second inclined surface 42 in the fitted state where the female housing 50 is fitted to the male housing 20.

With the connector 10B described above, magnitude and a change of the repulsive forces generated by the first inclined surface 41 and the second inclined surface 42 can be easily adjusted by varying the inclination angle of the second inclined surface 42 with respect to the first inclined surface 41. For example, the inclination angle of the second inclined surface 42 is gentler with respect to the first inclined surface 41 so that an overall repulsive force can be reduced to improve insertability. The inclination angle of the second inclined surface 42 is increased with respect to the first inclined surface 41 so that the overall repulsive force can be increased to improve recognizability of being in the process of fitting.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

Figure 10:
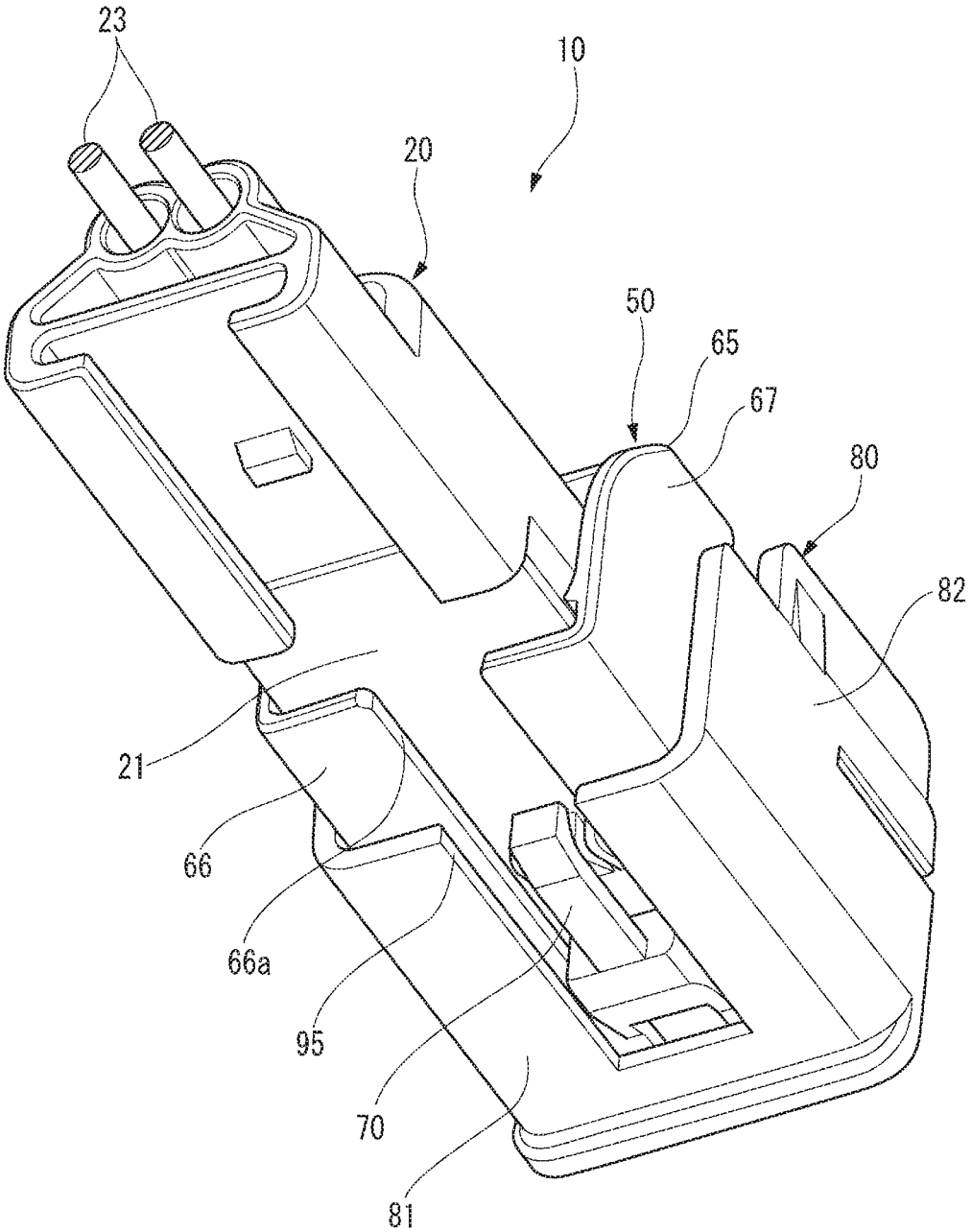
FIG. 10 is a perspective view of a connector including a protective wall of a different shape as viewed from a bottom side of the connector.
Figure 11:
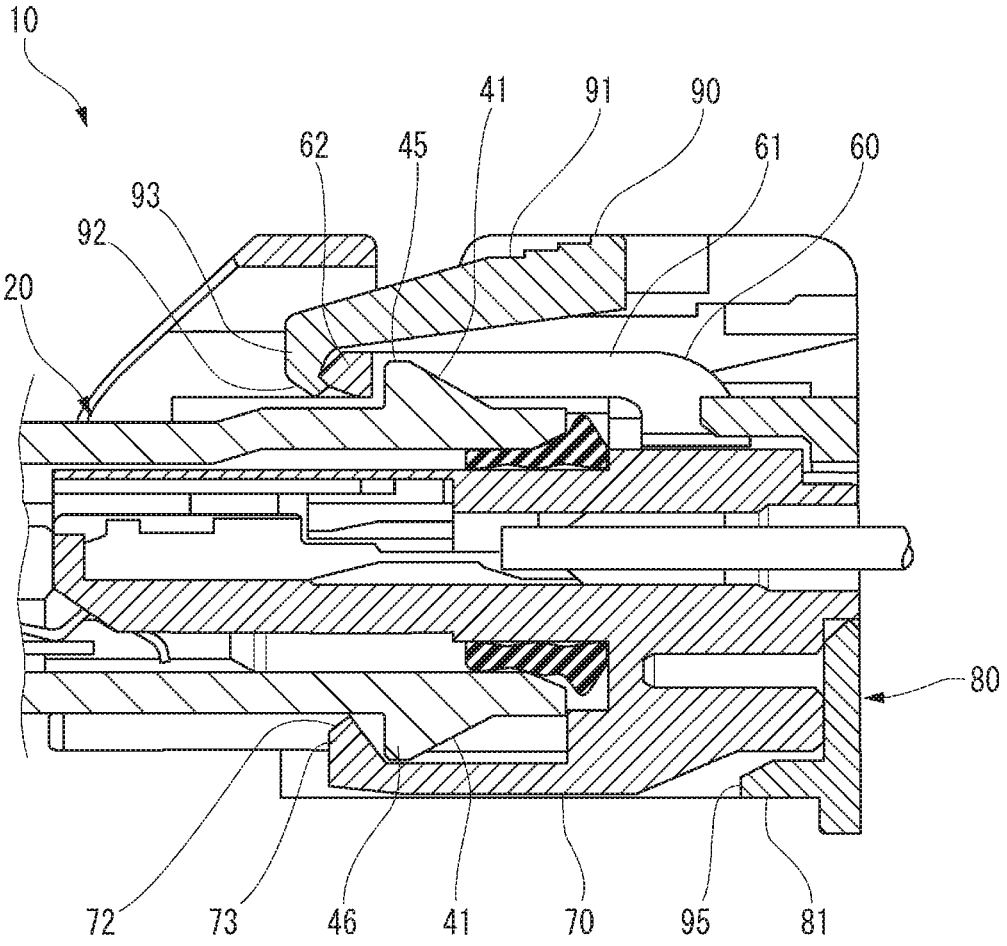
FIG. 11 is a side cross-sectional view of a part of the connector of FIG. 10.

For example, as illustrated in FIGS. 10 and 11, the protective wall 81 may be formed with only the opening portion 95 configured to house the second repulsive arm 70. In this case, the fitting assurance member 80 is attached to the female housing 50 so that the second repulsive arm 70 is disposed in the opening portion 95 of the protective wall 81 without protruding outward from the outer surface of the protective wall 81. Therefore, the second repulsive arm 70 does not protrude outside if the second repulsive arm 70 is not elastically deformed by the second inclined surface 42 so that the second repulsive arm 70 can be protected during transportation and in the fitted state.

According to an aspect of the exemplary embodiments described above, a connector includes a first housing (e.g., the male housing 20), a second housing (e.g., the female housing 50) configured to be fitted to the first housing, and a fitting assurance member (80) configured to be attached to the second housing and to be movable relative to the second housing in a fitted state in which the first housing and the second housing are fitted to each other. The first housing includes a lock protrusion (45), and a first inclined surface (41) and a second inclined surface (42). The first inclined surface (41) and the second inclined surface (42) are provided on opposite side surfaces. The second housing includes a lock arm (60) configured to lock the lock protrusion (45) in the fitted state. The fitting assurance member (80) includes a first repulsive arm (90) configured to generate repulsive force when the first repulsive arm (90) is elastically deformed by the first inclined surface (41) during a process of fitting the second housing to the first housing. The second housing includes a second repulsive arm (70) configured to generate repulsive force when the second repulsive arm (70) is elastically deformed by the second inclined surface (42) during the process of fitting the second housing to the first housing. The fitting assurance member (80) includes a protective wall (81) configured to protect the second repulsive arm (70) of the second housing.

The first repulsion arm (90) may be configured to lock the lock arm (60) already locking the lock protrusion (45) such that the fitting assurance member (80) maintains the fitted state.

The protective wall (81) may include an opening portion (95) in which the second repulsive arm (70) is disposed. The second repulsive arm (70) is disposed on an inner side from an outer surface of the protective wall (81) at least when the second repulsive arm (70) not being elastically deformed by the second inclined surface (42).

The fitting assurance member (80) may further comprise a rib (96) protruding outward from an edge portion of the opening portion (95) of the protective wall (81).

The fitting assurance member (80) may further comprise a cover (97) integrally provided on the protective wall (81) to cover an outer side of the opening portion (95).

An inclination angle of the second inclined surface (42) may be different from an inclination angle of the first inclined surface (41).

What is claimed is:

1. A connector comprising:

a first housing;

a second housing configured to be fitted to the first housing; and a fitting assurance member configured to be attached to the second housing and to be movable relative to the second housing in a fitted state in which the first housing and the second housing are fitted to each other, wherein the first housing comprises a lock protrusion, and a first inclined surface, and a second inclined surface, the first inclined surface and the second inclined surface being provided on opposite sides of the first housing, wherein the second housing comprises a lock arm configured to lock the lock protrusion in the fitted state, wherein the fitting assurance member comprises a first repulsive arm configured to generate repulsive force when the first repulsive arm is elastically deformed by the first inclined surface during a process of fitting the second housing to the first housing, wherein the second housing further comprises a second repulsive arm configured to generate repulsive force when the second repulsive arm is elastically deformed by the second inclined surface during the process of fitting the second housing to the first housing, and wherein the fitting assurance member further comprises a protective wall configured to protect the second repulsive arm of the second housing.

2. The connector according to claim 1, wherein the first repulsion arm is configured to lock the lock arm locking the lock protrusion such that the fitting assurance member maintains the fitted state.

3. The connector according to claim 1, wherein the protective wall includes an opening portion in which the second repulsive arm is disposed, and wherein the second repulsive arm is disposed on an inner side from an outer surface of the protective wall at least when the second repulsive arm is not being elastically deformed by the second inclined surface.

4. The connector according to claim 3, wherein the fitting assurance member further comprises a rib protruding outward from on an edge portion of the opening portion of the protective wall.

5. The connector according to claim 3, wherein the fitting assurance member further comprises a cover integrally provided on the protective wall to cover an outer side of the opening portion.

6. The connector according to claim 1, wherein an inclination angle of the second inclined surface is different from an inclination angle of the first inclined surface.

* * * * *